US006813886B2

(12) United States Patent
Cerruti et al.

(10) Patent No.: US 6,813,886 B2
(45) Date of Patent: Nov. 9, 2004

(54) THERMAL ACTUATION DEVICE

(75) Inventors: Daniele Cerruti, Fontanetto Po (IT); Giovanni Perruca, Motta de' Conti (IT)

(73) Assignee: Eltek S.p.A., Casale Monferrato (IT)

( * ) Notice: Subject to any disclaimer, the term of this patent is extended or adjusted under 35 U.S.C. 154(b) by 0 days.

(21) Appl. No.: 10/201,577

(22) Filed: Jul. 22, 2002

(65) Prior Publication Data

US 2003/0024244 A1 Feb. 6, 2003

(51) Int. Cl.[7] ..... F01B 29/10
(52) U.S. Cl. ..... 60/527; 60/528
(58) Field of Search ..... 60/527, 528, 529

(56) References Cited

U.S. PATENT DOCUMENTS 4,337,622 A * 7/1982 Johnson ..... 60/641.13
4,388,805 A * 6/1983 Rideout, Jr. ..... 60/527
5,442,914 A * 8/1995 Otsuka ..... 60/527
6,326,707 B1 * 12/2001 Gummin et al. ..... 310/12
6,388,359 B1 * 5/2002 Duelli et al. ..... 310/309

* cited by examiner

*Primary Examiner*—Hoang Nguyen
(74) *Attorney, Agent, or Firm*—Levine & Mandelbaum

(57) ABSTRACT

A Thermal actuation device has at least a heat expandable or deformable material, a heater, a power supply for the heating, a thruster capable of movement following expansion or distortion of a material, so as to perform a substantially predetermined stroke having a length from a first to a second position, at least an actuation element linearly following the action of the thruster so as to move with respect to a fixed structure from a first to a second position, and a resilient device able to return the thruster and/or actuation element respective first positions. A motion multiplyer actuated by the thrusting means is further provided for obtaining a stroke of the actuation element longer than the stroke of the thruster.

58 Claims, 6 Drawing Sheets

THERMAL ACTUATION DEVICE

BACKGROUND OF THE INVENTION

The present invention relates to a thermal actuation device.

Such devices, also known as thermo-actuators or electro-thermal linear motors, usually comprise a housing in which a thermal head is located, i.e. a device comprising a body made from a heat-conductive material (e.g. metal), in contact with an electric heater. Said body contains a heat expandable material (such as wax), and, at least partially, a rod or thrust element; the electric heater typically consists of a PTC resistor with a positive temperature coefficient electrically supplied by means of two terminals.

With the supply terminals live, the electric heater generates heat causing a volume increase of the heat expandable material: such a volume change will cause a linear displacement of the thruster outside the head body to move an actuation shaft up to a predetermined position, generally set by a mechanical limit stop. Upon ceasing the power supply, the heater cools down and the heat expandable material will shrink, causing the shaft and thruster to go back to their initial rest position, eventually with the help of a recall elastic element, such as a spring.

Thermal actuators as above have a simple low-cost manufacture and are usually highly reliable; other further significant advantages consist of a considerable power the are able to develop compared to their small size, and above all their noiseless operation; for these reasons, thermal actuators or electro-thermal actuators are widely used in various fields, such as for household appliances and environmental air conditioning.

However, the above devices have a drawback in that the stroke length they are able to obtain for the actuation shaft is rather limited.

Typically, a standardized thermal actuator as above with an outer housing about 15×20×45 mm and a thermal head about 6×6×20 mm, can move or actuate a charge of a few tenths of kilograms (e.g. 10–20 kg) for a displacement of a few millimeter (e.g. 6–8 mm).

In order to solve the drawback of a limited stroke, other devices have been recommended utilizing several thermal actuators.

For instance, EP-A-0 781 920 discloses an electro-thermal actuation device, in which the housings of two thermal actuators are solidly connected to another common container body; both thermal actuators, located in relevant fixed positions, are arranged in series to each other, for the relevant thrust elements to operate substantially along one same axis.

Both possible embodiments as described in the above document have the thrusters of the two thermal actuators either directed to opposite directions or facing each other; however, in both cases, said thrusters operate a thrust, on one side, to an anchoring means of the device, and on the other side to an actuation element, which will transmit the translation the device is provided for.

A plurality of different positions, i.e. a plurality of stable work positions for the actuation element can be obtained supplying one, the other or both thermal actuators operating in series; in particular, as of interest herein, a translation of the actuation element substantially equal to the sum of the useful strokes of the actuation shafts of both thermal actuators can be obtained by a simultaneous supply of both thermal actuators.

However, the device described in EP-A-0 781 920, which has a reliable manufacture and versatile utilization, is rather expensive and bulky; in this connection, another drawback concerning the device related to the document EP-A-0 781 920 is the presence of two functional elements being required (i.e. the anchoring means and the movable element), which extend from the two lengthwise ends of the main body of the device; the solution mentioned above also requires the use of at least two electric control elements.

SUMMARY OF THE INVENTION

It is the aim of the present invention to solve the above drawbacks.

In this frame, it is a first object of the present invention to provide a thermal actuation device, which is of simple compact manufacture, and while assuring both the reliability, power and noiseless features of common devices, is able to obtain significant strokes for a linearly movable actuation element, without requiring any complex or bulky mechanical kinematics, or any complex and expensive components and control circuits.

Another object of the present invention is to provide an actuation device comprising motion multiplying means, whose operating mode may be easily converted by orienting a component of said multiplying means in a different way, in particular making its movable actuation element capable of obtaining alternatively a thrust or a pull.

These and other aims, which will become apparent later, are obtained according to the present invention by an actuation device incorporating the features of the annexed claims, which are intended as an integral part of the present description.

DESCRIPTION OF THE DRAWINGS

Further aims, features and advantages of the present invention will become apparent from the following detailed description and annexed drawings, which are supplied by way of non limiting example, wherein.

DESCRIPTION OF THE PREFERRED EMBODIMENT

Figure 1:
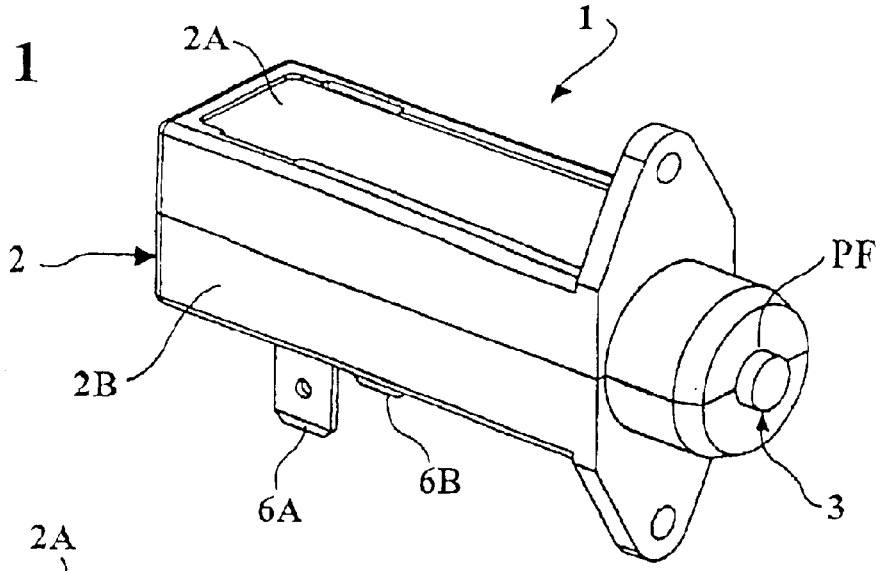
FIG. 1 shows a perspective view of an actuation device obtained according to the present invention, as a first possible embodiment.
Figure 2:
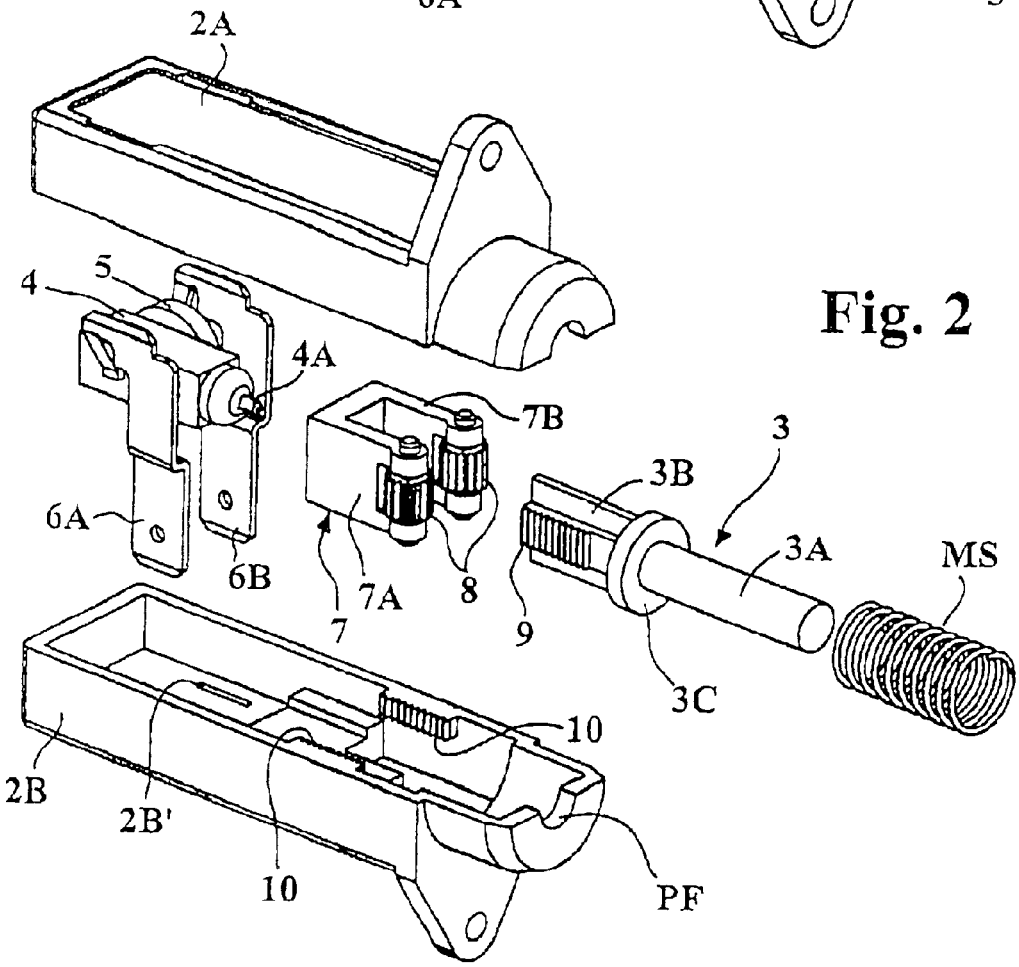
FIG. 2 shows an exploded view of the device of FIG. 1.
Figure 3:
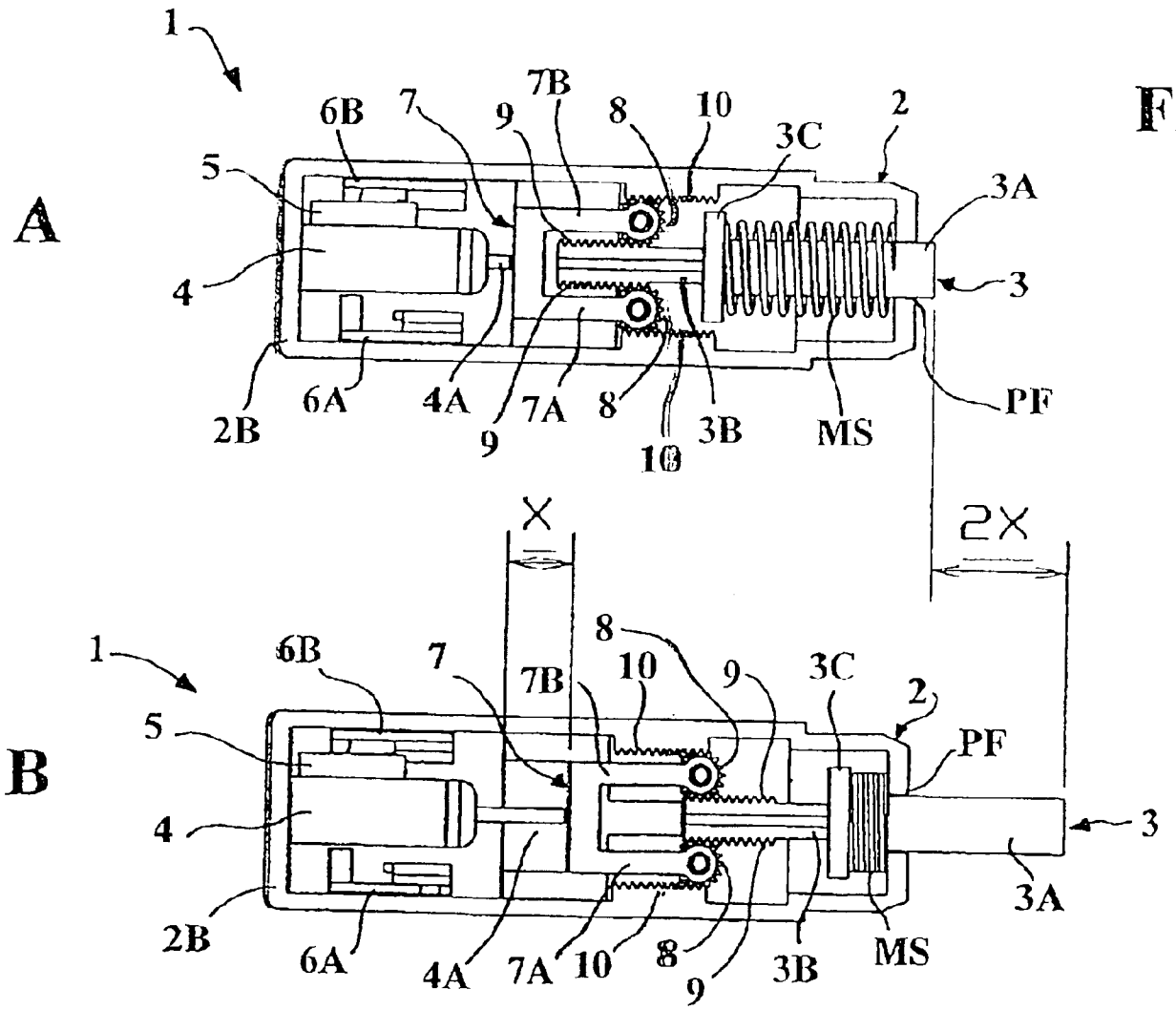
FIG. 3 shows a section of the device of FIG. 1, in two different operating conditions.

FIGS. 1, 2 and 3 are representing a first possible embodiment of the actuation device according to the present invention, which is apt to move an interlocked device, such as a dispensing element of a washing agents dispenser of a washing machine.

In the example described above, the device indicated as a whole with 1 is a thermal-electric operating device, which comprises a body 2 consisting of two shells 2A and 2B made from thermoplastic material commonly coupled to each other; the body 2 has a front passage PF for an operational shaft 3, capable of linear motion.

As it can be noticed in FIG. 2, the body formed by the shells 2A and 2B is housing a thermal head 4 inside, which consists of a body made from an electric and heat conductive material (such as metal) containing a heat expandable material (e.g. wax); the head 4 is fitted with a relevant rod or thrusting element 4A; one end of the thruster 4A is inserted inside the body of the head 4, whereas the other end protrudes out of it. The thruster 4A is apt to perform a predetermined stroke, the length of which is assumed to be 6 millimeter for ease of description.

Reference 5 indicates a heating element, such as a PTC thermistor with positive temperature coefficient, for the body of the head 4; 6A and 6B indicate two electric power supply terminals for the heating element 5; as it will be noticed, the terminal 6A lays in direct contact with the body of the head 4, whereas the terminal 6B is in contact with the heating element 5, the latter being in its turn in contact with the body of the head 4, also operating as a contact bridge between the terminal 6A and the heating element 5; from FIG. 1 it can be noticed how a portion of the contacts 6A and 6B is protruding out of the body 2 through the openings delimited in the shell 2B (one of them can be seen in 2B' of FIG. 2), in order to ensure electric connection through suitable conductors.

In FIG. 2, reference 7 indicates as a whole a fork element substantially in the form of an "U", which is provided to be moved by the thruster 4A; the fork element 7 has two substantially parallel arms 7A and 7B, on whose ends two gears or toothed wheels 8 are commonly pivoted, being able to rotate.

Always in FIG. 2, reference 3 indicates as a whole the operation shaft mentioned above, which has a first substantially cylindrical portion 3A and a flattened portion 3B, both portions being separated from each other by means of a flange 3C.

The cylindrical portion 3A is provided to slide in the front passage PF of the body 2, and an elastic element will be slipped on it, such as a spiral spring MS; the spring MS is provided for operating between the flange 3C of the shaft 3 and the portion of the body 2, where the passage PF is delimited (see FIG. 3).

Respective first racks 9 in substantially parallel positions are delimited on both faces of the flattened portion 3B for cooperating with the toothed wheels 8 of the fork element 7, as further described.

Finally, reference 10 indicates two second opposite racks, which are delimited on the inner surface of two parallel sides of the shell 2A; as it will be seen, also the racks 10 are provided for cooperating with the toothed wheels 8 of the fork element 7.

In FIG. 3, the device 1 is shown by respective sections in two different operating conditions, i.e. in a non-supply condition of the head 4 (section A of FIG. 3) and a supply condition of the head 4 (section B of FIG. 3).

The arrangement of the various components of the device 1 inside the relevant body 2 can be noticed from FIG. 3.

As it can be seen, the head 4, with the heating element 5 and relevant terminals 6, is substantially located on one end of the body 2, so as to have its rear side in contact with the bottom wall of the body 2 and the thruster 4A facing in the direction of the front passage PF. The fork element 7 is located before the thruster 4A.

As it can be noticed in the section A of FIG. 3, i.e. the non-supply condition of the head 4 (i.e. the thruster 4A is in its reared position), the toothed wheels 8 are engaged to the initial length of the racks 10 with reference to the movement direction of the fork element 7; in the same condition, the flattened portion 3B is inserted between the parallel arms 7A and 7B of the fork element 7, so that the toothed wheels 8 are engaged to the final length of the racks 9 with reference to the movement direction of the shaft 3.

As previously mentioned, the spring MS is slipped over the portion 3A of the shaft 3, between the flange 3C and the surface of the body 2 in which the passage PF is delimited, so that its elastic reaction will maintain the components 3 and 7 in the above positions; therefore, in this condition, only a minimum part of the portion 3A of the shaft 3 protrudes out of the front passage PF of the body 2.

When electric power is supplied to the contacts 6A and 6B, the heating element 5 generates heat on the body of the head 4, so as to cause expansion of the heat expandable material contained therein. This expansion causes a linear motion of the thruster 4A outward of the body of the head 4 to produce a thrust on the fork element 7, which will go forward linearly.

During this movement, the toothed wheels 8 are rotated by the racks 10, one wheel rotating clockwise and the other anticlockwise; this rotation induced to the toothed wheels 8 by the racks 10 will obviously produce a simultaneous advancement of the racks 9 with respect to the wheels themselves, and consequently an advancement of the shaft 3 contrasting the elastic reaction of the spring MS.

At the end of the maximum stroke of the thruster 4A, the device will be in the condition illustrated in the section B of FIG. 3, where the toothed wheels 8 are engaged to the final length of the racks 10 with reference to the movement direction of the fork element 7, and on the initial length of the racks 9 with reference to the movement direction of the shaft 3.

In this condition, a further protrusion of the thruster 4A from the body of the head 4 is hindered, on one hand, by the spring MS fully compressed between the flange 3C of the shaft 3 and the surface of the body 2 in which the passage PF is delimited, on the other hand, a possible backing of the body of the head 4 is hindered by the contact between the latter and the bottom wall of the body 2; obviously, as an alternative, appropriate limit stops solidly connected to the body 2 may be provided, which are apt to limit the shaft stroke 3 upon reaching a predetermined position.

In the example described in FIG. 3, the ratio between toothing/dimensions of the wheels 8 and the racks 9 and 10 is such that a 6 millimeter linear movement of the fork element 7 (i.e. corresponding to the maximum stroke of the thruster 4A) equals a 12 millimeter linear movement of the shaft 3.

Therefore, as it can be noticed, motion multiplying means are provided according to the present invention, which operate to cause a longer stroke of the actuation element consisting of the shaft 3, in particular a double stroke with respect to the stroke of the thrusting means 4A of the head 4.

Upon ceasing the electric power supply to the contacts 6A and 6B, the heating element 5 cools down with a consequent shrinking of the material contained inside the body of the head 4; thus, due to the action of the spring MS the thruster 4A, fork element 7 and shaft 3 can go back to their initial rest positions as shown in the section A of FIG. 3.

The kinematics of the embodiment shown in the FIGS. 1–3 consists of two rack groups 9, 10 and gears 8, substantially identical and mirror-like, in particular with the purpose of ensuring a centred operation with low frictions of the operation shaft 3; however, nothing will hinder utilizing only one of said rack and gear groups (i.e. as if the kinematics of FIG. 3 were divided along the axis of the shaft 3).

Moreover, as described above by way of example, in order to obtain a double displacement of the shaft 3 with respect to the stroke of the thruster 4A, the resulting force available on the same shaft 3 is half the force exerted simultaneously by the thruster 4A.

However, the advantage of such a configuration is that the force of the spring MS can be halved compared to an analogous spring thrusting directly on the thruster 4A, being able at the same time to overcome the inner frictions of the thermal head 4 and let said thruster 4A go back inside.

FIGS. 4–8 represent a second possible embodiment of an actuation device 1' according to the present invention, being apt to move an interlocked device, which also in this instance is assumed to be e.g. a dispensing element of a washing agents dispenser of a washing machine.

Figure 4:
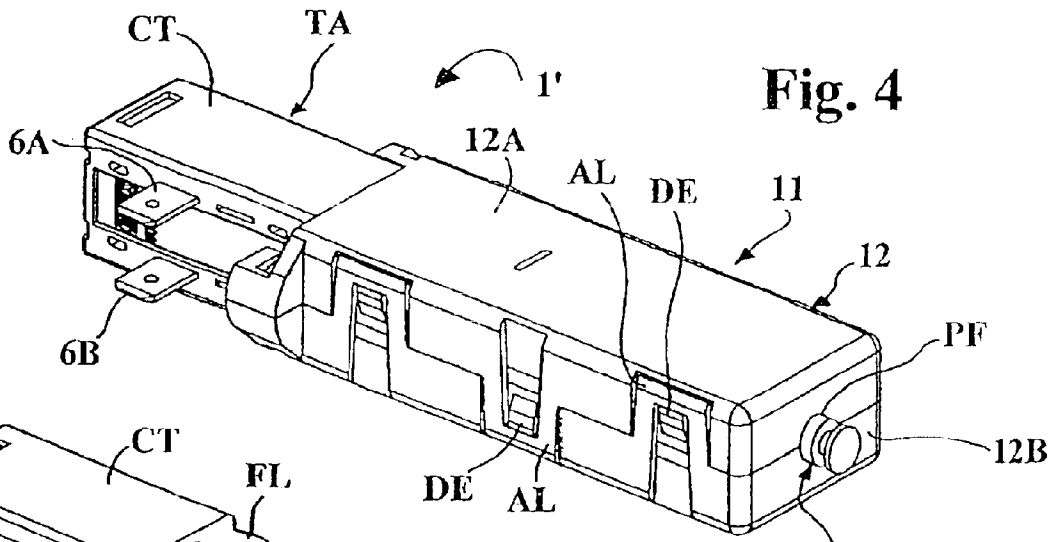
FIG. 4 shows a perspective view of an actuation device obtained according to the present invention, as a second possible embodiment.
Figure 5:
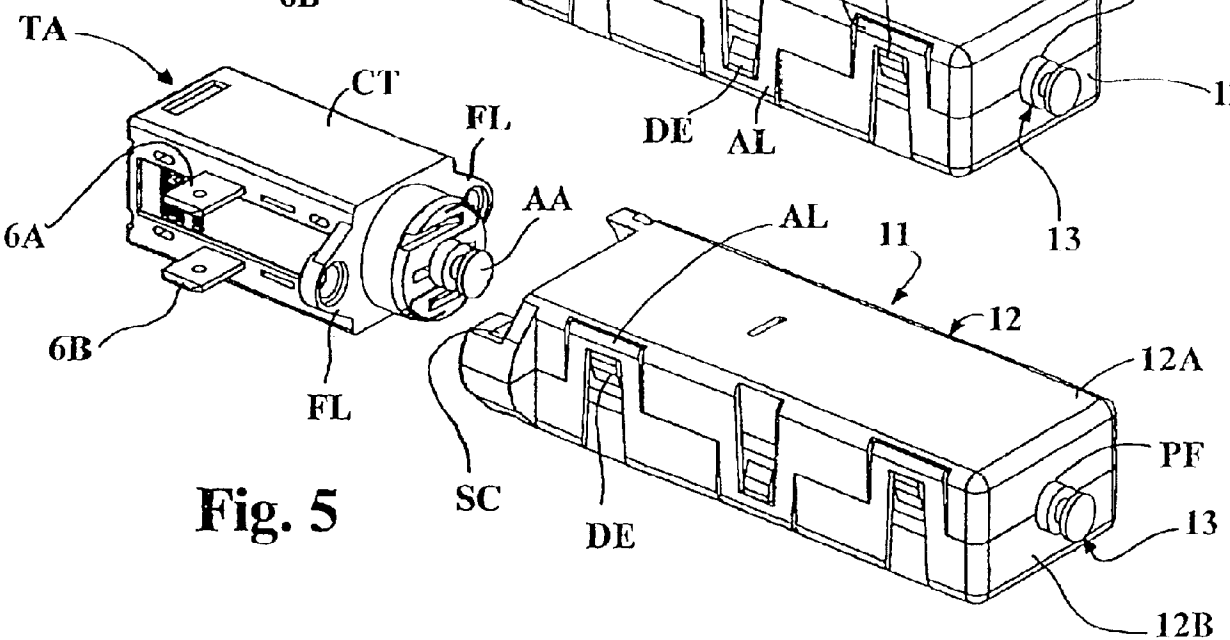
FIG. 5 shows a partially exploded view of the device of FIG. 4.

As it can be seen by comparing FIGS. 4 and 5, in the above example the device 1' according to the present invention consists of two main parts coupled together, i.e. a thermal actuator TA and an adaptor element 11.

The thermal actuator TA is obtained according to a substantially common technique, such as described in the document EP-A-0 953 198, whose teachings in this connection are considered incorporated herein for reference; in this frame, the thermal actuator TA comprises a body CT made from two shells of thermoplastic material coupled to each other, in which a thermal head similar to the one previously indicated with 4 is provided, fitted with a heating element and relevant electric power terminals 6A and 6B; the head of the thermal actuator TA comprises a thruster similar to the one previously indicated with 4A, which is apt to thrust on a first end of an actuator shaft and move it linearly contrasting the action of a spring; the other end of such an operation shaft, indicated with AA in FIG. 5, is partially protruding from a front passage of the body of the thermal actuator TA; also in this instance a 6 millimeter stroke is assumed to be the maximum stroke of the above thruster for simplicity's sake.

Finally, the body of the thermal actuator TA has side fastening flanges indicated with FL.

The adaptor element 11 comprises a body 12 consisting of two shells 12A and 12B made from thermoplastic material, commonly coupled to each other, such as through mutually hooking wings AL and teeth DE; the body 12 has a front passage PF for an operation shaft 13 capable of a linear movement; each shell 12A and 12B also has some cooperating seats SC being apt to receive and retain the fastening flanges FL of the thermal actuator TA, so as to rigidly couple the latter to the adaptor element 11.

Figure 6:
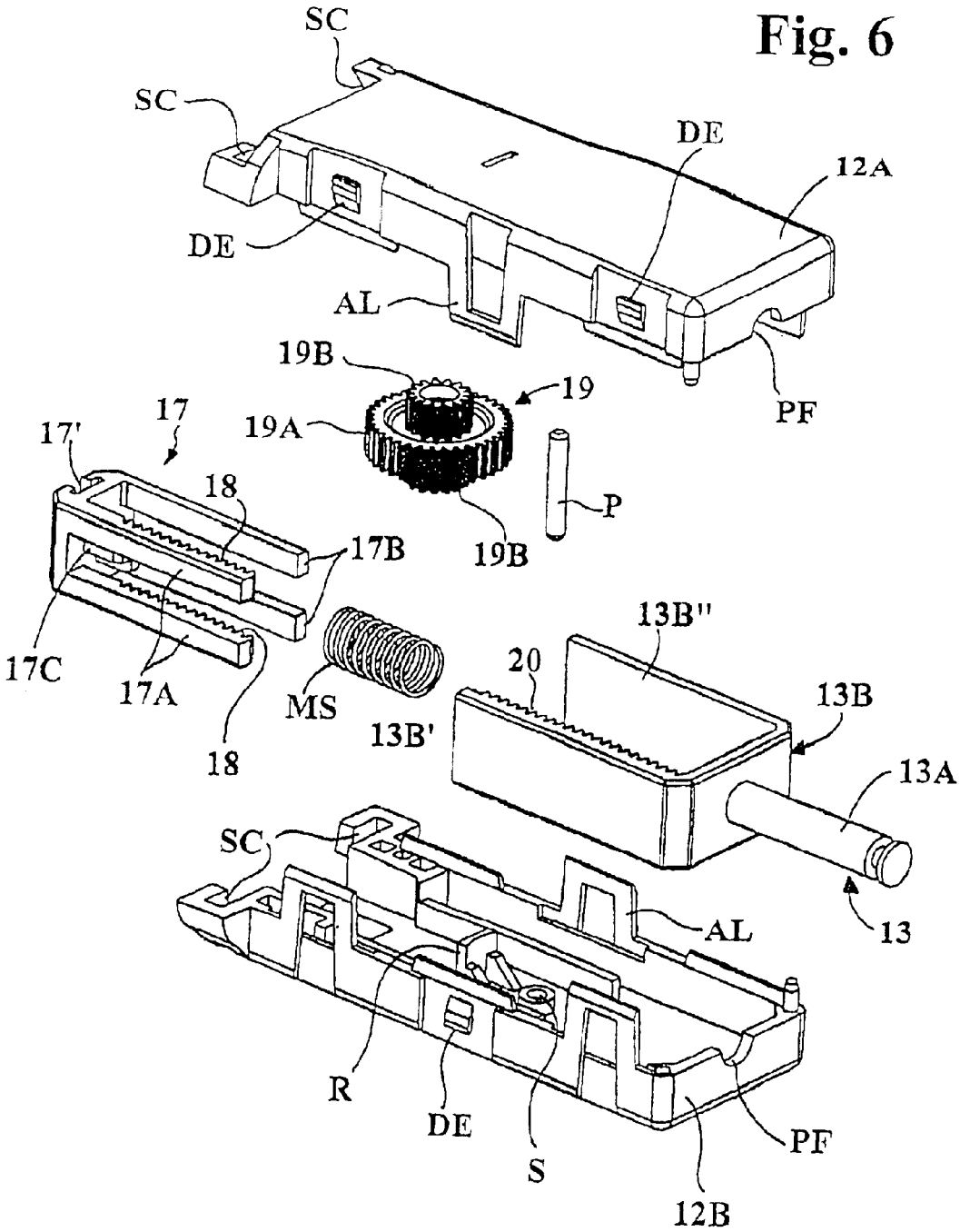
FIG. 6 shows an exploded view of one component of the device of FIG. 4.

FIG. 6 illustrates the components housed inside the body 12 formed by the shells 12A and 12B.

In this figure, reference 17 indicates as a whole a first fork element to be motioned through the actuation shaft AA of the thermal actuator TA; to this purpose, the fork element 17 comprises a seat 17', appropriate for coupling to a grooved end of the shaft AA of the thermal actuator TA.

The fork element 17 has two pairs of parallel arms 17A and 7B; the arms 17A laying on one same side of the fork element 17 delimit a respective rack 18 on their surface facing the arms 17B.

Reference 19 indicates as a whole a gear, which comprises a main toothed wheel 19A and two side toothed wheels 19B similar to each other, the first ones having larger dimensions and a higher number of teeth than the second one.

The gear 19 has an axial passage being apt to receive a pin P, the ends of which are provided to enter respective seats S delimited in the shells 12A and 12B.

Reference MS indicates an elastic element, which consists of a spiral spring in the example described above; an end of such a spring MS will be slipped over an extension 17C of the fork element, whereas the other end is provided to rest on a striker R elevating from the inner surface of the shell 12A.

Always in FIG. 6, reference 13 indicates as a whole the above operation shaft, which has a substantially cylindrical first portion 13A, which is provided for sliding in the front passage PF of the body 12.

The portion 13B of the shaft 13 remaining inside the body 12, on the contrary, is fork shaped and as such has two parallel arms 13B' and 13B"; a rack 20 is delimited on the face of the arm 13B' facing the other arm 13B".

Figure 7:
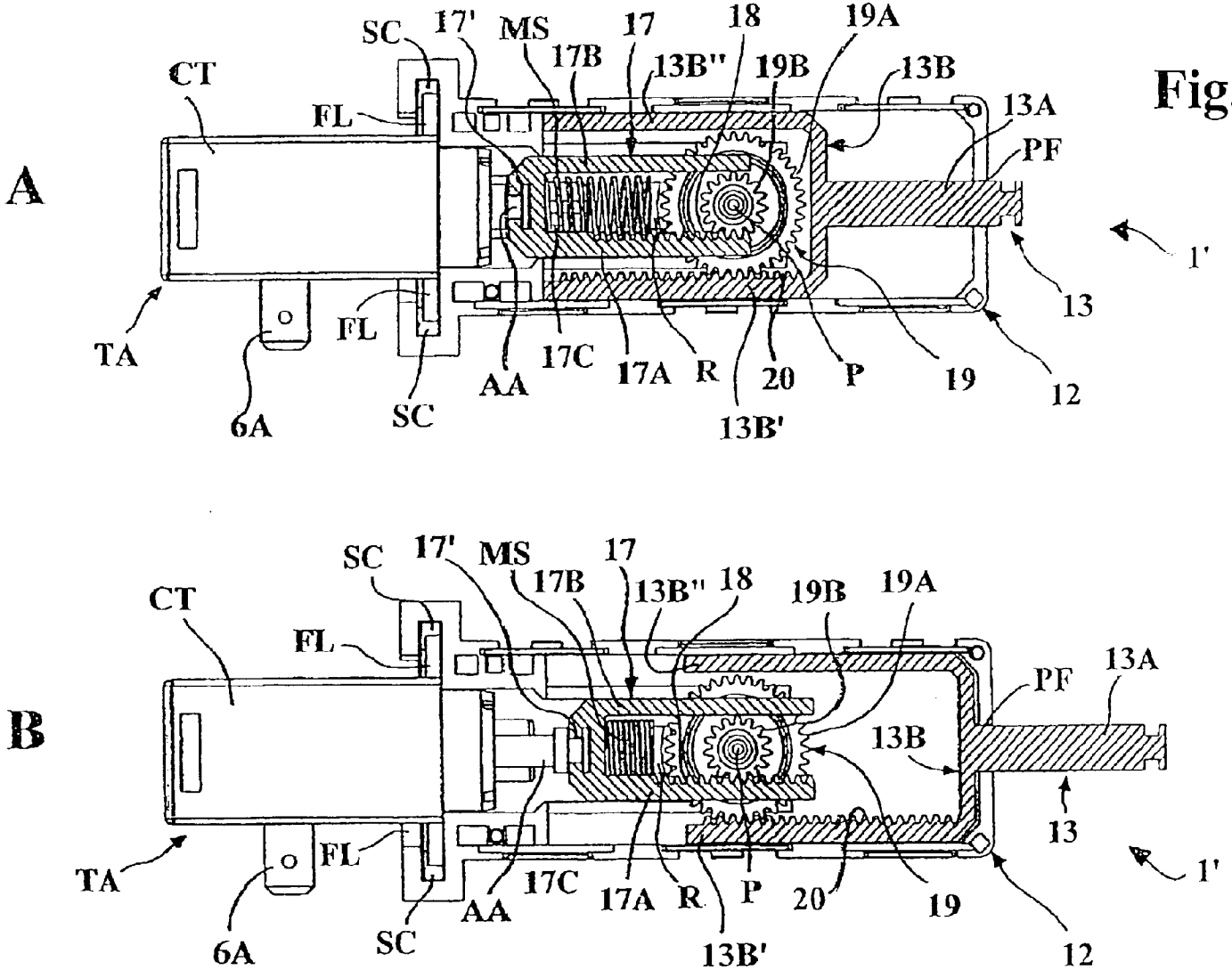
FIG. 7 shows a partial view of the device of FIG. 4, in a first employment condition and two different operating positions.

The first racks 18 related to the arms 17A of the fork element 17 are provided for engaging the side toothed wheels 19B of the gear 19, whereas the second rack 20 related to the arm 13B' of the fork portion 13B of the shaft 13 will engage the main toothed wheel 19A of the gear 19; as it can be noticed in the instance of the FIGS. 6 and 7, the shaft 13 is so positioned to have the arm 13B' of the portion 13B, on which the rack 20 is delimited, located on the same side of the arms 17A of the fork element 17.

In the FIG. 7, the device 1' according to the implementation of FIGS. 4–6 is represented by means of respective sections and two different operating conditions; in particular, in the section A of FIG. 7 the device according to the invention is represented in a non-supply condition of the thermal actuator TA, whereas in the section B of the same figure the device 1 is represented in a supply condition of the thermal actuator TA.

FIG. 7 is illustrating the arrangement of the various components of the adaptor element 11 inside the relevant body 12.

As it can be noticed, on the side opposite to the side with the passage PF, the body 12 delimits an opening in which the front end of the body CT of the thermal actuator TA can be inserted; from the figure it can also be noticed how the body CT of the thermal actuator is coupled to the body 12 of the adaptor element 11 by the flanges FL and seats SC, as well as the grooved end of the shaft AA of the thermal actuator TA is coupled in the seat 17' of the fork element 17.

As can be seen in the section A of FIG. 7, in a non-supply condition of the thermal actuator TA (i.e. with its actuation shaft AA in a reared position), the side toothed wheels 19B of the gear 19 are each one engaged to the final length of the racks 18 of the fork element 17, with reference to the movement direction of the latter; in the same condition, the main toothed wheel 19A of the gear 19 is engaged to the final length of the rack 20, with reference to the movement direction of the shaft 13.

As previously mentioned, the spring MS is slipped over one end on the extension 17C of the fork element 17 while resting on the other end on the striker R, so its elastic reaction will maintain the components 13 and 17 in the above position; therefore, in this condition, from the front passage PF of the body 12 it will only protrude with a minimum section of the portion 13A of the shaft 13.

When the contacts 6A and 6B of the thermal actuator TA are power supplied, the inner heating element of the latter generates heat on the body of the relevant head and cause expansion of the heat expandable material contained therein as well as a consequent linear motion of the relevant thruster; this movement causes a corresponding movement of the actuation shaft AA in a linear forward direction.

The movement of the shaft AA causes a forward motion of the fork element 17, contrasting the elastic reaction of the spring MS, so the first racks 18 engaged to the side toothed wheels 19B will produce anticlockwise rotation of the gear 19 around the pin P.

This rotation of the gear 19 will also cause an angular movement of the main toothed wheel 19A with a simultaneous forward motion of the rack 20 with respect to the wheel itself and consequently a forward motion of the shaft 13.

At the end of the maximum stroke of the actuation shaft AA, the device according to the invention is in the condition illustrated in the section B of FIG. 7, where the side toothed wheels 19B are engaged to an intermediate length of the racks 18, with reference to the movement direction of the fork element 17, and on the initial length of the rack 20, with reference to the movement direction of the shaft 13. In this condition, the further protrusion of the actuation shaft AA (and consequently of the thruster from the inner thermal head of the thermal actuator TA) is hindered by the spring MS, which is completely pressed between the fork element 17 and striker R.

In the example shown in FIG. 7, the toothing/dimensions ratio of the wheels 19A, 19B and racks 18, 20 is such that a 6 millimeter linear movement of the fork element 17 (i.e. corresponding to the maximum stroke of the actuation shaft AA) corresponds to about 15 millimeter linear movement of the shaft 13.

Therefore, as it can be noticed, according to the invention, also in this case motion multiplying means are provided, which operate to have the stroke of the actuation element formed by the shaft 13 longer than the stroke of the shaft AA of the thermal actuator TA.

It should also be noticed how thermal actuators as for the one previously indicated with TA are standard components, i.e. manufactured in large series production for a large range of possible applications; therefore, provision of an adaptor element 11 entails obvious advantages in terms of manufacturing normalization and utilization flexibility.

The embodiment shown in the FIGS. 4–7 is particularly advantageous, since manufacture using the same components as described above also allows manufacture of an actuation device, the shaft 13 of which is provided for a pull instead of a thrust, as in the example previously described.

To this purpose, during the assembly stage of the above components it will be actually enough to orientate and locate the shaft 13 on the gear 19 differently from the instance of FIG. 7. In particular, as it can be noticed in FIG. 8, should the shaft 13 be provided for a pull:

the shaft 13 would be positioned in the body 2 with the arm 13B' of the portion 13B, where the rack 20 is delimited, laying on the opposite side of the gear 19 with respect to the side bearing the arms 17A of the fork element 17, on which the racks 18 are delimited;

in the non-supply condition of the thermal actuator TA, the main toothed wheel 19A of the gear 19 would be engaged to the initial length of the rack 20, with reference to the movement direction of the shaft 13.

Figure 8:
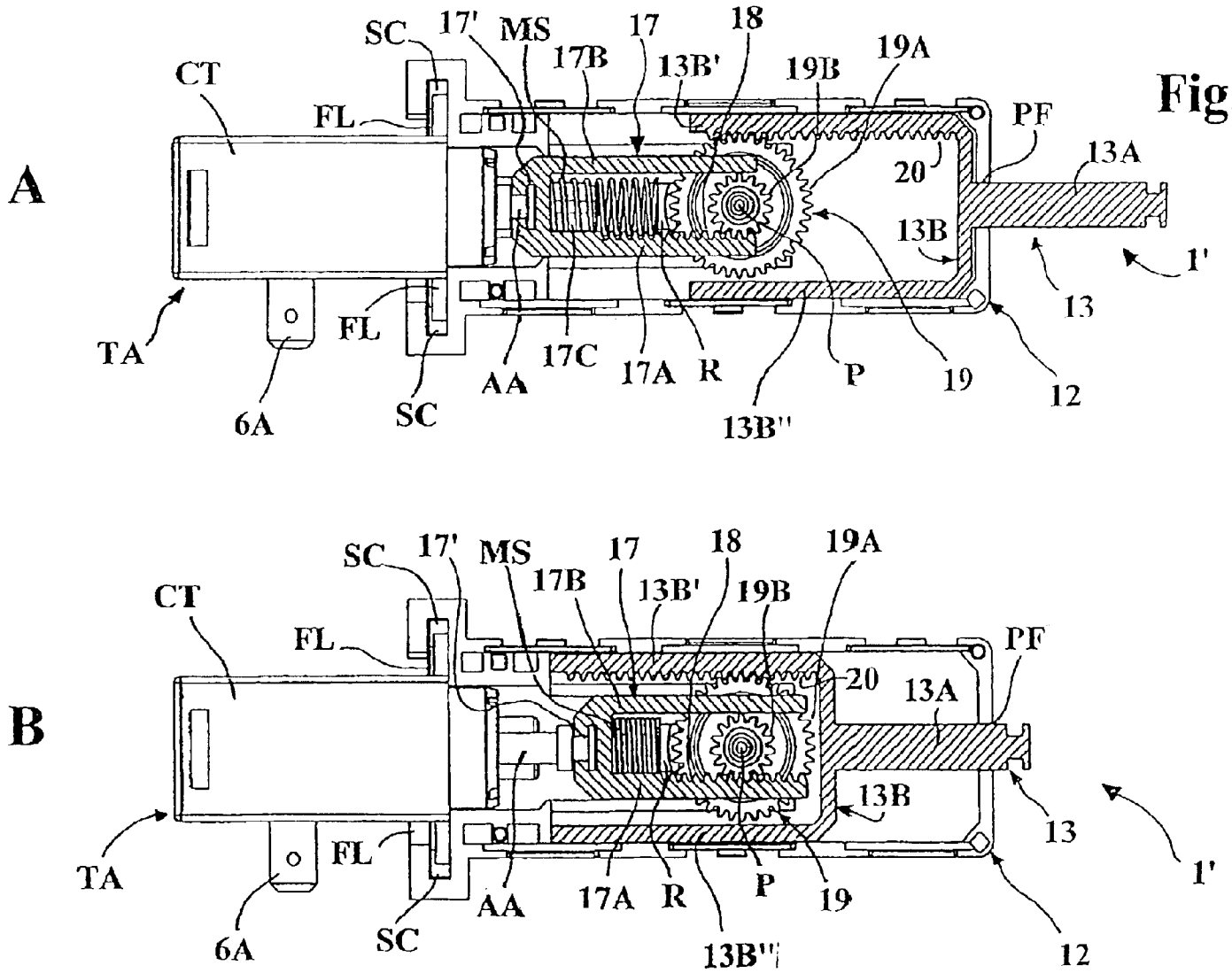
FIG. 8 shows a partial section of the device of FIG. 4, in a second employment condition and two different operating positions.

This assembly of non-supply condition of the thermal actuator TA, is illustrated in the section A of the FIG. 8.

In this utilization form, after electric power supply to the thermal actuator TA and the consequent linear movement of the shaft AA, the fork element 17 will move forward contrasting the elastic reaction of the spring MS; the first racks 18, engaged to the side toothed wheels 19B produce an anticlockwise rotation of the gear 19 around the pin P. The angular movement of the main toothed wheel 19A causes a simultaneous movement of the rack 20 on the other side with respect to the toothed wheel 19A, and consequently a backing of the shaft 13.

At the end of the maximum stroke of the actuation shaft AA, the device 1' is in the condition illustrated in the section B of FIG. 8, where the side toothed wheels 19B are engaged to an intermediate length of the racks 18, with reference to the movement direction of the fork element 17, and the main toothed wheel 19A is engaged to the initial length of the rack 20, with reference to the movement direction of the shaft 13.

Also in the example of FIG. 8, the toothing/dimensions ratio of the wheels 19A, 19B and of the racks 18, 20 is such that a 6 millimeter linear movement of the fork element 17 will correspond to about 15 millimeter linear movement of the shaft 13 (ratio 1 : 2,5).

It is quite obvious that the same conversion effect of the device 1', i.e. from a thrust operating actuator to a pulled operating actuator may also be obtained by tilting over the arrangement of the fork element 17 with respect to the illustration of FIG. 7. In particular, should the shaft 13 be provided for obtaining a pull, the fork element 17 would be positioned in the body 2 to have the arm 17A, on which the rack 18 is delimited, operating on the upper section of the gear 19, with reference to FIG. 7 (and consequently from the opposite side where the arm 13B' of the portion 13B is located, on which the rack 20 is delimited), and in a non-supply condition of the thermal actuator TA, the main toothed wheel 19A of the gear 19 would be engaged to the initial length of the rack 20, with reference to the movement direction of the shaft 13.

From the above description the features of the actuation device according to the present invention are clear, and also its advantages are clear. The solution is based on the use of simple, compact, cost effective and reliable components, without requiring any complicated kinematics, circuits or operating sequences.

As previously mentioned, the device according to the present invention can be advantageously utilized in the field of domestic appliances, in particular as an actuator for liquid flow deviator systems or dispensing elements of washing agents dispensers. Moreover, it can be further used for air conditioning and hydraulic systems in general, where the device according to the present invention will provide an efficient actuator for bulkheads or duct valves, according to their different opening and/or angle shot degrees.

Finally, it is clear that many changes are possible for the man skilled in the art to the actuation device described by way of example, without departing from the novelty principles of the inventive idea.

The embodiment shown in the FIGS. 1–8 is described with reference to a special thermal electric actuator comprising a wax expanding with heat, but it is clear that this embodiment is capable of application for other thermal or thermo-electric actuators, such as with a different heat expandable material, or containing a heat expandable gas or liquid, or actuators comprising a heat deformable material, such as bi-metal actuators or any alloy actuators having a form retaining memory.

Obviously, the above transmission ratio of the motion multiplying means 7–10 and 17–20 may be modified if required by simply replacing at least some components provided, such as the kinematics means 9 and 20 and/or the kinematics means 10 and 19.

What is claimed is:

1. A thermal actuation device comprising at least:

a heat expandable or deformable material, heating means, means for electric power supply to such heating means, thrusting means, capable of movement following an expansion or deformation of such a material, so as to perform a substantially predetermined stroke length from a first to a second position, at least an actuation element, being linearly motioned following the action of said thrusting means, so as to perform a substantially predetermined stroke length with respect to a fixed structure or body of the device, from a first to a second position, elastic or resilient means, being apt to restore or return said thrusting means and/or said actuation element to their respective first position, further comprising motion multiplying means mechanically coupled to, and actuated in response to movement of said thrusting means through its stroke, said multiplying means not comprising any thrusting means but producing a greater stroke than the stroke of said thrusting means.

2. A device according to claim 1, wherein said motion multiplying means comprise first kinematics means actuated by said actuation element, cooperating with said second kinematics means and operatively associated to said structure or body.

3. A device according to claim 2, wherein said first kinematics means comprise first rack means.

4. A device according to claim 3, wherein said second kinematics means comprise a rack.

5. A device according to claim 1, wherein said motion multiplying means further comprise a transmission element, interlaying between said thrusting means and said actuation element.

6. A device according to claim 4, wherein said motion multiplying means further comprise at least a toothed wheel, carried by a transmission element and engaged to both said first rack means and said secondrack means.

7. A device according to claim 2, wherein said second kinematics means comprise a rotating toothed element, coupled to said structure or body with rotation capability.

8. A device according to claims 3 or 7, wherein said motion multiplying means further comprise second rack means carried by said transmission element, said rotating toothed element being engaged to both said first rack means and said second rack means.

9. A device according to claim 2, wherein said first rack means are delimited in a first element associated to said actuation element.

10. A device according to claim 2, wherein said rack is delimited in said structure or body.

11. A device according to claim 6, wherein the rotation axis of said toothed wheel is linearly translatable.

12. A device according to claim 1, wherein said transmission element is substantially in the form of a fork.

13. A device according to claim 1, wherein said transmission element comprises at least a pair of arms.

14. A device according to claim 6, wherein said toothed wheel is pivoted on one end of one said arms.

15. A device according to claim 14, further comprising a second toothed wheel pivoted on one end of said other arm).

16. A device according to claim 15, wherein said first rack means are engaged to both said toothed wheels and operatively located between the latter.

17. A device according to claim 3, wherein said first rack means are delimited at least on one of said arms.

18. A device according to claim 7, wherein said rotating toothed element comprises a first main toothed wheel and two side toothed wheels coaxial to each other, where size and number of teeth of the first one are greater than for the second ones.

19. A device according to claim 8, wherein said transmission element comprises two pairs of arms, said second rack means are delimited at least on one of the arms of each pair and are engaged to said side toothed element, said first rack means are engaged to said main toothed wheel.

20. A device according to claim 9, wherein said first element is formed by a portion of said actuation element, said first rack means being delimited at least on a surface of said portion.

21. A device according to claim 16, wherein said first rack means are delimited on two parallel surface of said portion, said portion being inserted between said two arms.

22. A device according to claim 20, wherein said portion is in the form of a fork, comprising two parallel arms, said-first rack means being delimited on a surface of one of said arms.

23. A device according to claim 1, wherein said actuation element is movable in order to exert a thrust.

24. A device according to claim 23, wherein the arm of a portion on which a first rack means are delimited is located on the same side of said rotating toothed element with respect to the side bearing the arm or the arms of said transmission element, on which a second rack means are delimited.

25. A device according to claim 1, wherein said actuation element is movable in order to exert a pull.

26. A device according to the claims 8 or 25, wherein the arm of said portion on which said first rack means are delimited is located on the opposite side of said rotating toothed element with respect to the side bearing the arm or the arms of said transmission element, on which said second rack means are delimited.

27. A device according to claim 1 or 9, wherein said actuation element is capable of assembly in two alternative positions with respect to said structure or body so as to alternately obtain an actuation device whose actuation element is movable for exerting a thrust, or an actuation device whose actuation element is movable for exerting a pull.

28. A device according to claim 5, wherein said transmission element is capable of assembly in two alternative positions with respect to said structure or body, so as to alternately obtain an actuation device whose actuation element is movable for exerting a thrust, or an actuation device whose actuation element is movable for exerting a pull.

29. A device according to claim 27, wherein a first rack means and a second rack means are arranged on opposite sides with respect to said rotating toothed element in case of a movable actuation element for exerting a pull.

30. A device according to claim 1, wherein said elastic means are interlaid between said first element or actuation element and said structure or body of the device.

31. A device according to claim 5, wherein said elastic means are interlaid between said transmission element and said structure or body of the device.

32. A device according to claim 1, wherein said structure comprises a fixed body consisting of two sections coupled to each other, said body containing at least said motion multiplying means.

33. A device according to claim 32, wherein said fixed body has a passage for at least a portion of said actuation element to slide through.

34. A device according to claim 1, wherein said fixed body houses at least a container for said heat expandable material, said heating means, said thrusting means and at least a portion of said actuation element.

35. A device according to claim 1, wherein at least said heating means, said thrusting means and a container of said heat expandable material are part of an actuator in the form of a separated component with respect to said fixed body, the former being coupled to the latter.

36. A device according to at claim 3, wherein the transmission ratio of said motion multiplying means can be changed by replacing at least said first kinematics means and/or said second kinematics means.

37. A device according to claim 1, wherein said heat expandable or deformable material, said heating means, said means for electric power supply to said heating means and said thrusting means are part of a standard thermal actuator, whereas said actuation device and said motion multiplying means are part of an adaptor device connectable to said standard thermal actuator.

38. An actuation device, comprising:

actuating means having linear movable thrusting means for performing a substantially predetermined stroke length, at least an actuation element, linear movable following the action of said thrusting means, for performing a substantially predetermined stroke length, motion multiplying kinematic means for performing a longer stroke of said actuation element than the stroke of said thrusting means, said motion multiplying kinematic means comprising at least a component capable of assembly in two different operating positions with respect to a fixed structure or body of the device, for obtaining alternatively a device whose actuation element is movable for exerting a thrust or a device whose actuation element is movable for exerting a pull.

39. A device according to the claim 38, wherein said motion multiplying kinematic means comprise at least a rotating toothed element, which is operatively engaged to first rack means and second rack means, where operation of said thrusting means causes a displacement of said first rack means with respect to said rotating toothed element, with a consequent rotation of the latter, rotation of said rotating toothed element causing a displacement of said second rack means with respect to said rotating toothed element, said second rack mean being operatively connected to said actuation element, at least one between said first and second rack means being capable of assembly in two alternative positions with respect to a relevant fixed structure of the device, in order to obtain alternatively a device, whose actuation element is movable for exerting a thrust or a device whose actuation element is movable for exerting a pull.

40. A thermal actuation device comprising at least:

a heat expandable or deformable material, heating means, means for electric power supply to such heating means, thrusting means, capable of movement following an expansion or deformation of said material, so as to perform a substantially predetermined stroke length from a first to a second position, at least an actuation element, being linearly motioned following the action of such thrusting means, so as to perform a substantially predetermined stroke length from a first to a second position, with respect to a fixed structure or body of the device, elastic or resilient means in said container body, being apt to restore or return said thrusting means and/or said actuation element to their respective first position, wherein said container body further provides motion multiplying kinematic means housed inside, which operate for obtaining a longer stroke of said actuation element than the stroke of said thrusting means.

41. A device according to claim 38, wherein said motion multiplying kinematic means comprise first rack means, at least a rotating toothed element, engaged to said first rack means, second rack means, engaged to said rotating toothed element, a first element, capable of performing linear movements with respect to said container body and operatively associated to said thrusting means for producing an angle shot movement of said rotating toothed element, a second element, to which said second rack means are operatively associated and capable of performing linear movements with respect to said structure, for determining the stroke of said actuation element.

42. An actuation device comprising:

actuating means of a thermal type having linear movable thrusting means for performing a substantially predetermined stroke length, at least a actuation element linearly movable following the action of said thrusting means for performing a substantially predetermined stroke length, motion multiplying kinematic means, associated with said actuation element for obtaining a longer stroke of said actuation element than the stroke of said thrusting means, said multiplying kinematic means comprising at least a rotating toothed element, which is operatively engaged to first rack means and second rack means, the operation of said thrusting means causing a displacement of the actuation element in an opposite direction to the direction of said thrusting means.

43. Application of the actuation device according to claim 1, said device being included in a domestic appliance.

44. Application of the actuation device according to claim 1, said device being included in a washing agents dispenser.

45. Application of the actuation device according to claim 1, said device being included in an environmental air conditioning apparatuses.

46. A device according to claims 4, 8 or 28, wherein a first rack means and a second rack means are arranged on one same side with respect to said rotating toothed element in case of a movable actuation element for exerting a thrust.

47. A thermal actuation device comprising at least:

a heat expandable or deformable material, thrusting means, capable of movement following an expansion or deformation of such a material, so As to perform a substantially predetermined stroke length from a first to a second position, at least an actuation element, being linearly motioned following the action of said thrusting means, so as to perform a substantially predetermined stroke length with respect to a fixed structure or body of the device, from a first to a second position, elastic or resilient means, being apt to restore or return said thrusting means and/or said actuation element to their respective first position, further comprising motion multiplying means mechanically coupled to, and actuated in response to movement of, said thrusting means through its stroke, said multiplying means not comprising any thrusting means but producing a stroke greater than the stroke of said thrusting means.

48. A device according to claim 47, wherein said motion multiplying means comprise:

first rack means actuated by said actuation element, cooperating with second tack means and operatively associated to said structure or body, a transmission element, interlaying between said thruster and said actuation element.

49. A device according to claim 48, wherein said motion multiplying means further comprise at least a toothed wheel, carried by a transmission element and engaged to both said first rack means and said second rack means.

50. A device according to claim 48, wherein said motion multiplying means comprise a rotating toothed element, coupled to said structure or body with rotation capability.

51. A device according to claim 50, wherein said second rack means are associated to said transmission element such in a way that said rotating toothed element is engaged to both said first rack means and said second rack means.

52. A device according to claim 51, wherein said transmission element comprises two pairs of arms, said second rack means are delimited at least on one of the arms of each pair and are engaged to a side toothed wheels belonging to said rotating toothed element, said-first at rack means being engaged to a main toothed wheel belonging to said rotating toothed element, said main toothed wheel having more theet with respect to said side toothed wheels.

53. A device according to claim 51 or 52, wherein said first rack means and said second rack means are arranged on one same side with respect to said rotating toothed element.

54. A device according to claim 51 or 52, wherein said first rack means and said second rack means are arranged on opposite sides with respect to said rotating toothed element.

55. A device according to claim 47, comprising heating means and means for electric power supply to such heating means.

56. A device according to claim 1 or 38 or 40 or 47, wherein said fixed structure or body of the device comprises at least two parts or shells apt to be coupled each other.

57. A device according to claim 8, wherein the arm of a portion on which a first rack means are delimited is located on the same side of said rotating toothed element with respect to the side bearing the arm or the arms of said transmission element, on which a second rack means are delimited.

58. A device according to claim 8, wherein a first rack means and a second rack means are arranged on opposite sides with respect to said rotating toothed element in case of a movable actuation element for exerting a pull.

* * * * *